US011320237B2

(12) United States Patent
Tedder et al.

(10) Patent No.: US 11,320,237 B2
(45) Date of Patent: May 3, 2022

(54) HOLSTER MOUNTS

(71) Applicant: Tedder Industries, LLC, Post Falls, ID (US)

(72) Inventors: Thomas Tedder, Post Falls, ID (US); Silas Van Natter, Post Falls, ID (US); Timothy Treto, Mead, WA (US); Drew Stephens, Coeur d'Alene, ID (US)

( * ) Notice: Subject to any disclaimer, the term of this patent is extended or adjusted under 35 U.S.C. 154(b) by 169 days.

(21) Appl. No.: 16/735,193

(22) Filed: Jan. 6, 2020

(65) Prior Publication Data

US 2020/0141694 A1 May 7, 2020

Related U.S. Application Data

(62) Division of application No. 15/874,708, filed on Jan. 18, 2018, now Pat. No. 10,578,397.

(60) Provisional application No. 62/447,751, filed on Jan. 18, 2017.

(51) Int. Cl.
*F41C 33/04* (2006.01)
*F42B 39/02* (2006.01)

(52) U.S. Cl.
CPC ..... *F41C 33/041* (2013.01); *F41C 33/043* (2013.01); *F41C 33/046* (2013.01); *F42B 39/02* (2013.01)

(58) Field of Classification Search
CPC ..... F41C 33/041; F41C 33/046; F41C 33/04; F41C 33/043; F41C 33/048; F41C 33/02; F41C 33/006; F41C 33/0236; F42B 39/02; A45F 2200/0591; A45F 5/021
See application file for complete search history.

(56) References Cited

U.S. PATENT DOCUMENTS 4,419,794 A * 12/1983 Horton, Jr. ..... A45F 5/02 224/197
5,375,749 A * 12/1994 Oliva ..... A45F 5/02 224/242
5,540,368 A * 7/1996 Oliva ..... A45F 5/02 224/242
5,584,423 A * 12/1996 Wang ..... A45F 5/021 224/197
6,286,737 B1 * 9/2001 Whitley ..... H04M 1/04 224/196
6,385,890 B1 * 5/2002 Amadini ..... F41A 17/02 224/243
8,544,706 B2 * 10/2013 Crye ..... F41C 33/045 224/198
9,791,250 B1 * 10/2017 Pestana ..... F42B 39/02
10,101,119 B2 * 10/2018 Tedder ..... F41C 33/02
(Continued)

*Primary Examiner* — Brian D Nash

(57) ABSTRACT

Representative implementations of devices and techniques provide a holster mount assembly, to mount and to support an implement (such as a handgun, for example) or an implement holster (such as a handgun holster or shell, for example), or the like, in a variety of configurations. The holster mount assembly is arranged to be worn on a user's person, clothing, or gear (backpacks, gear packs, accessories, straps, belts, etc.), for example, for temporarily and safely carrying the implement, while making the implement easily accessible to the user. In various embodiments, the holster mount assembly is comprised of two primary components, where one of the two components is coupled to the implement or implement holster.

19 Claims, 11 Drawing Sheets

(56) References Cited

U.S. PATENT DOCUMENTS

| | | | | |
|---|---|---|---|---|
| 10,119,783 | B2 * | 11/2018 | Tedder | F41C 33/041 |
| 10,274,296 | B2 * | 4/2019 | Tedder | F42B 39/02 |
| 10,295,305 | B2 * | 5/2019 | Tedder | F41C 33/041 |
| 10,302,391 | B1 * | 5/2019 | Akar | F41C 33/0263 |
| 10,782,094 | B2 * | 9/2020 | Rogers | F41C 33/045 |
| 2002/0134803 | A1 * | 9/2002 | Lowe | F41C 33/0209 224/243 |
| 2006/0011680 | A1 * | 1/2006 | Cook | F41C 33/0227 224/243 |
| 2007/0226958 | A1 * | 10/2007 | Clifton | A45F 5/02 24/3.12 |
| 2011/0174847 | A1 * | 7/2011 | Crye | F41C 33/0236 224/243 |
| 2013/0181018 | A1 * | 7/2013 | Kendrick | F41C 33/02 224/193 |
| 2013/0181021 | A1 * | 7/2013 | Yarbrough | F41C 33/0263 224/244 |
| 2015/0285587 | A1 * | 10/2015 | Abushaev | F41C 33/0281 224/193 |
| 2016/0238342 | A1 * | 8/2016 | Tedder | F41C 33/0263 |
| 2018/0100720 | A1 * | 4/2018 | Tedder | F41C 33/041 |
| 2018/0142990 | A1 * | 5/2018 | Tedder | F41C 33/048 |
| 2019/0219358 | A1 * | 7/2019 | Rogers | F41C 33/043 |
| 2019/0219359 | A1 * | 7/2019 | Rogers | F41C 33/045 |
| 2020/0072575 | A1 * | 3/2020 | Hellweg | F41C 33/0263 |

* cited by examiner

HOLSTER MOUNTS

TO RELATED APPLICATIONS

This application is a divisional of U.S. patent application Ser. No. 15/874,708, filed Jan. 18, 2018, which claims the benefit under 35 U.S.C. § 119(e)(1) of U.S. Provisional Application No. 62/447,751, filed Jan. 18, 2017, both of which are hereby incorporated by reference in their entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished. In some cases, such as with a handgun for example, the holster may allow the user to conceal the implement, or to conceal the fact that the user is carrying the implement.

In the case of a handgun, the holster should reasonably protect the handgun and the user, and should be convenient to the user for ready use. However, the holster should also be versatile enough to be comfortably carried by the user, such as when it is worn on the person of the user for an extended length of time. The holster should also be rigid and stable enough to allow the handgun to be repeatedly drawn and re-holstered, usually with the same hand.

Holster mounting accessories are often used to mount a holster to an article of clothing for wear by the user. A holster mounting accessory should reliably retain the holster, supporting the weight of the holster and the implement within. The mounting accessory should allow the user to draw the handgun for use without undue effort or difficulty, and to replace the handgun in the holster easily. The mounting accessory should retain the holster during the drawing and reholstering, and any other activity that may put a strain on the holster, mounting accessory, or the user's clothing.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Figure 1:
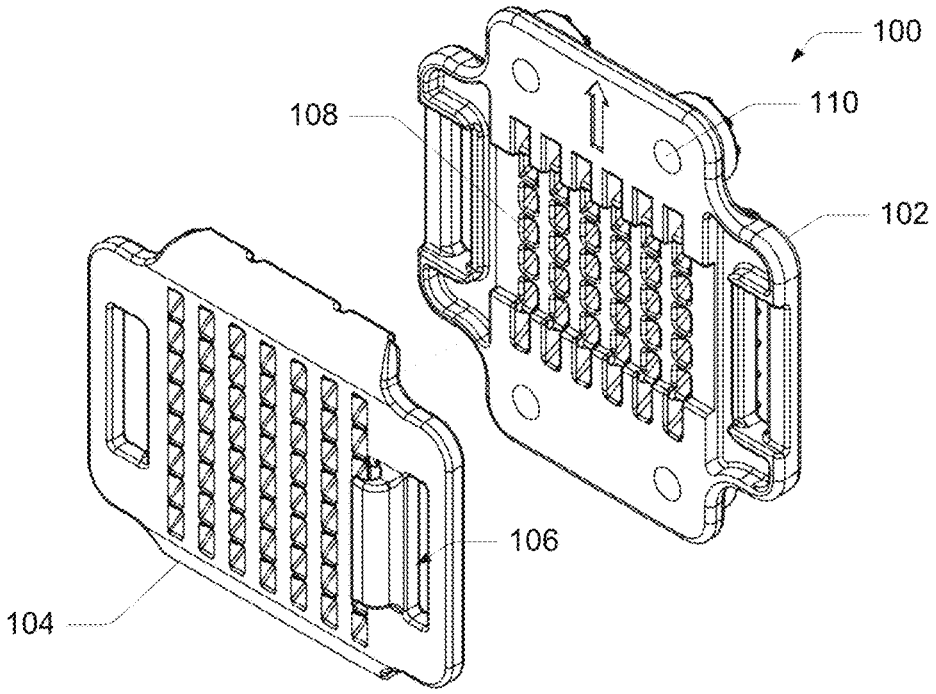
FIG. 1 shows a perspective view of an example mount assembly, according to an embodiment.

Representative implementations of devices and techniques provide a holster mount assembly, to mount and to support an implement (such as a handgun, for example) or an implement holster (such as a handgun holster or shell, for example), or the like, in a variety of configurations. The holster mount assembly is arranged to be worn on a user's person, clothing, or gear (backpacks, gear packs, accessories, straps, belts, etc.), for example, for temporarily and safely carrying the implement, while making the implement easily accessible to the user.

In various examples, the holster mount assembly can be mounted to the user's clothing or gear for carrying the implement externally or in a concealed manner. The holster mount assembly can also be worn on any other part of a user's person, or can be used to support an implement or implement holster in another location, that is not on a user.

In one embodiment, the mount assembly comprises a two (or more) piece strap mount assembly. The components of the mount assembly are sandwiched over a strap or the like, to firmly secure the mount assembly to the strap (i.e., compress the strap between the two plates of the mount assembly). A holster or other item can be temporarily or permanently coupled to one or more of the mount components. The mount assembly can be moved by releasing the tension (loosening the coupling fasteners or straps) between the components, sliding the mount assembly to a new location, and tightening the fasteners to press the components together.

In another embodiment, the mount assembly comprises a two (or more) piece panel mount assembly. A panel component of the mount assembly is slid behind or between a strap, set of straps, webbing, or the like. A hooked or ridged portion of the panel component helps to engage the strap. A keeper component is fitted onto an edge of the panel component to trap the strap on the panel and prevent the panel component from sliding off the strap. A holster or other item can be temporarily or permanently coupled to the panel component.

In a further embodiment, the mount assembly comprises a two (or more) piece slide mount assembly. A first receiver component of the mount assembly includes a groove having a predefined cross-sectional shape. A second component of the mount assembly comprises a slide component configured to snugly fit into the groove of the receiver component. The mount assembly may include a lock button arranged to lock the slide component in place on the receiver component in one or more positions. A holster or other item can be temporarily or permanently coupled to the slide component and the receiver component can be temporarily or permanently coupled to one of various surfaces, items for attaching the holster to a user, or the like.

Techniques and devices are discussed with reference to example handgun holsters illustrated in the figures. However, this is not intended to be limiting, and is for ease of discussion and illustrative convenience. The techniques and devices discussed may be applied to a holster or to any of various cases, carriers, containers, implements, tools, objects, and the like, and remain within the scope of the disclosure. For the purposes of this disclosure, the generic term "carrier" is used to indicate any or all of the above.

Further, the shape and quantity of the mount assembly components illustrated in the figures may vary to accommodate various applications. In alternate embodiments, fewer, additional, or alternate components may be used and/or combined to form a mount assembly having an equivalent function and operation.

Implementations are explained in more detail below using a plurality of examples. Although various implementations and examples are discussed here and below, further implementations and examples may be possible by combining the features and elements of individual implementations and examples.

Example Embodiments

Example mount assemblies 100, 400, and 2500 are shown in FIGS. 1-36. In various implementations, a mount assembly ("mount") 100, 400, or 2500 may be removably coupled to a carrier or the like for mounting the carrier in a variety of configurations, including on a person. In some implementations, multiple mounts 100, 400, or 2500 can be coupled to a carrier. More commonly, multiple mounts 100, 400, or 2500, or mount 100, 400, or 2500 components, can be coupled to various surfaces or articles, for mounting the carrier to the surfaces or articles as the user changes locations or activities.

Figure 2:
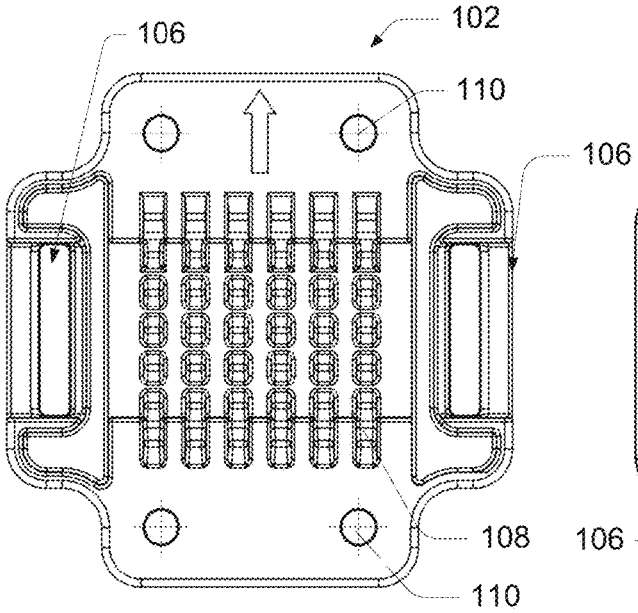
FIG. 2 illustrates an example front plate of the mount assembly of FIG. 1, according to an implementation.
Figure 3:
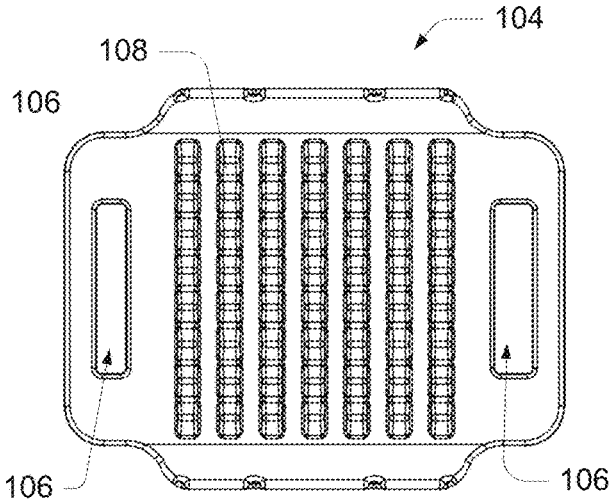
FIG. 3 illustrates an example hinge plate of the mount assembly of FIG. 1, according to an implementation.
Figure 4:
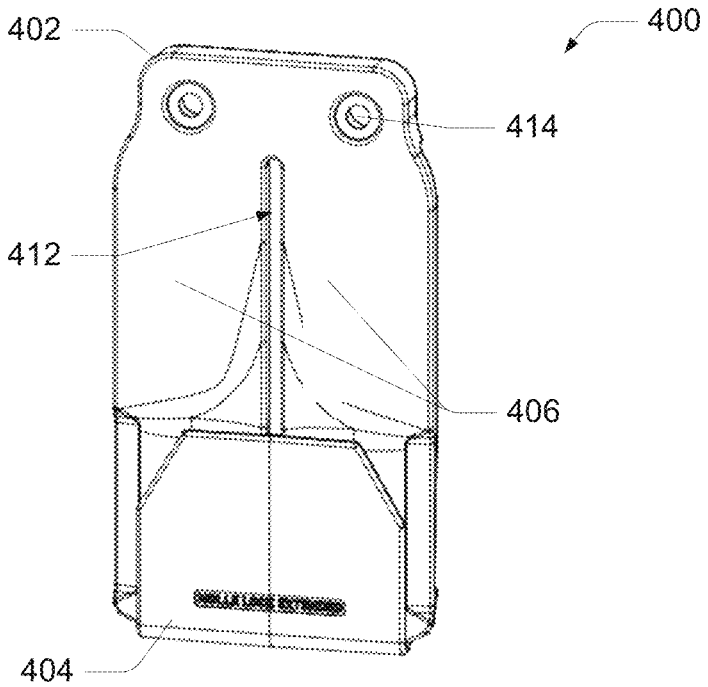
FIGS. 4 and 5 show perspective views of an example mount assembly, according to another embodiment.
Figure 5:
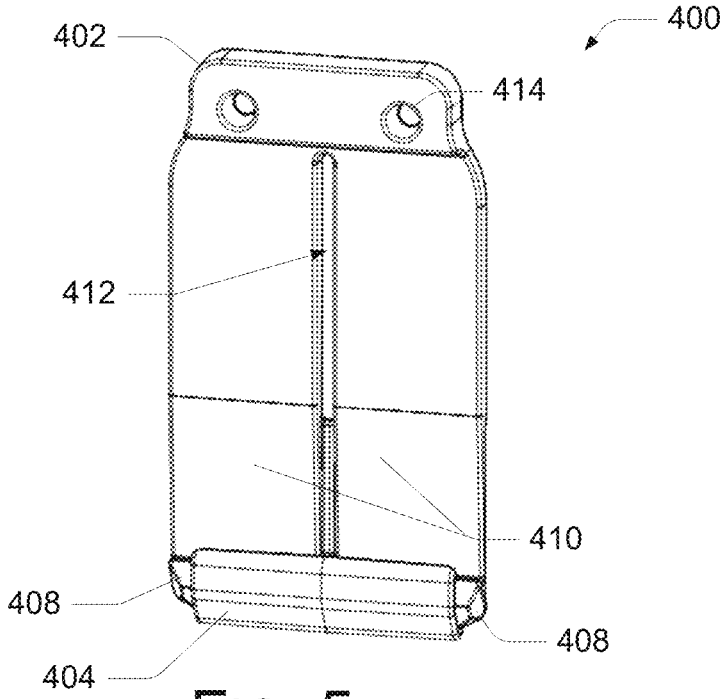
Figure 6:
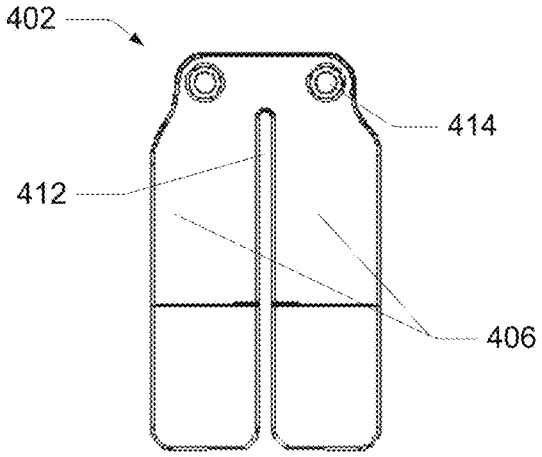
FIGS. 6-10 show views of an example panel mount, of the mount assembly of FIG. 4, according to an implementation.
Figure 7:
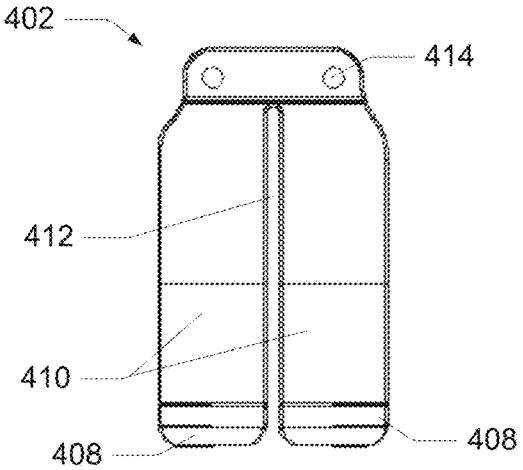
Figure 8:
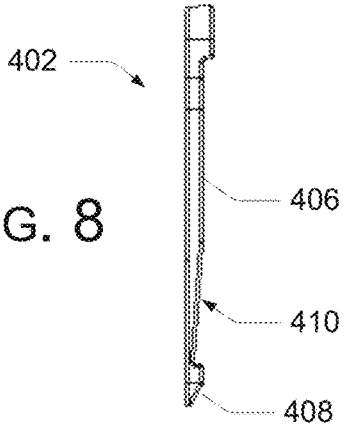
Figure 9:
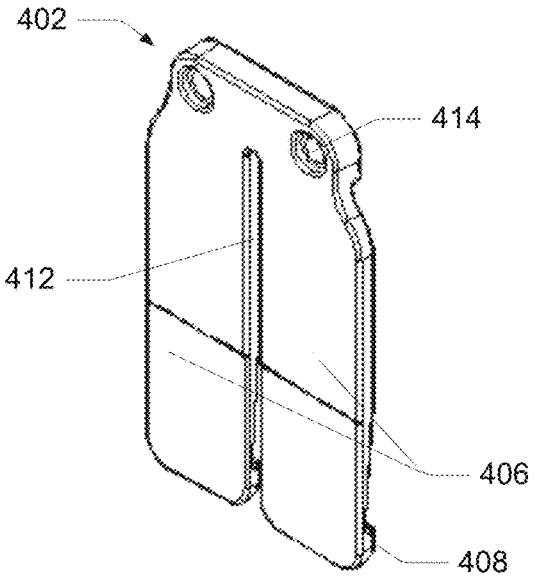
Figure 10:
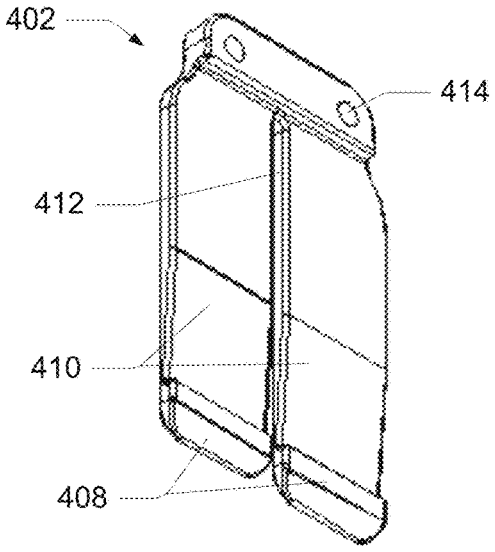
Figure 11:
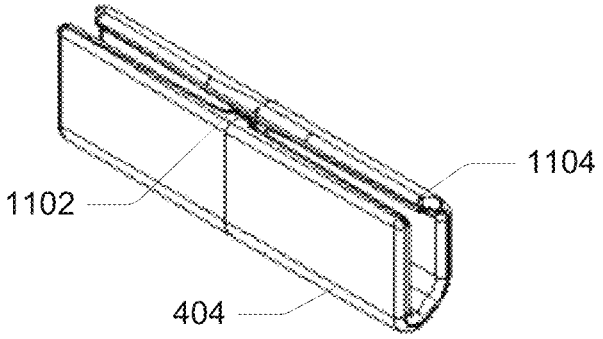
FIGS. 11-14 show views of an example keeper, of the mount assembly of FIG. 4, according to an implementation.
Figure 12:
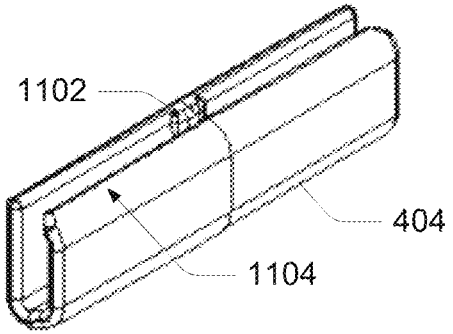
Figure 13:
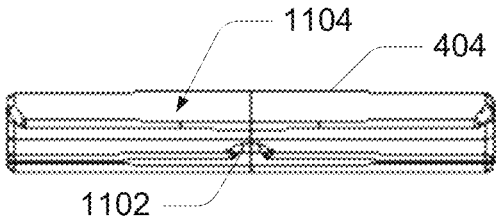
Figure 14:
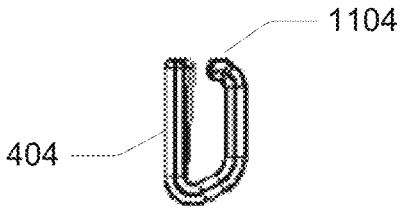
Figure 15:
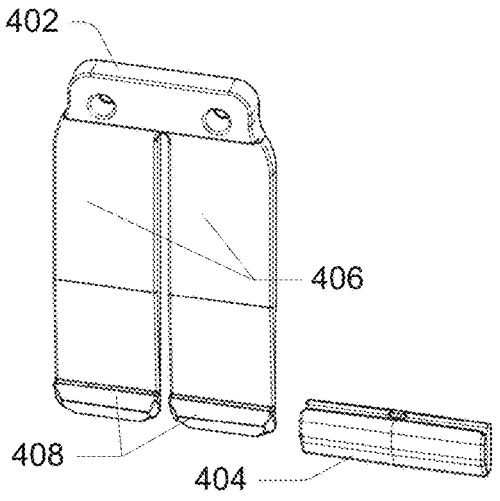
FIGS. 15-18 show an example of fitting a keeper onto a panel mount of the mount assembly of FIG. 4, according to an implementation.
Figure 16:
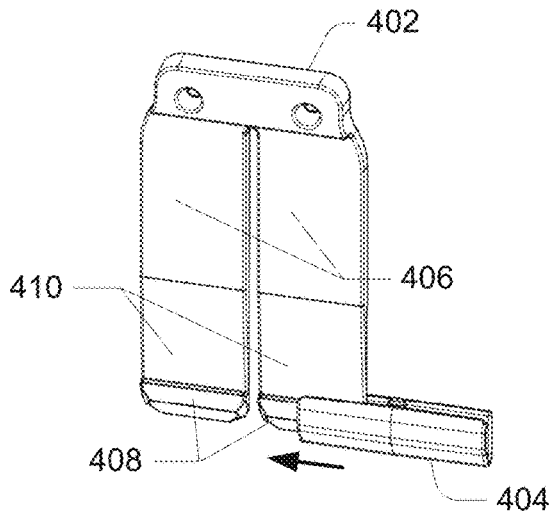
Figure 17:
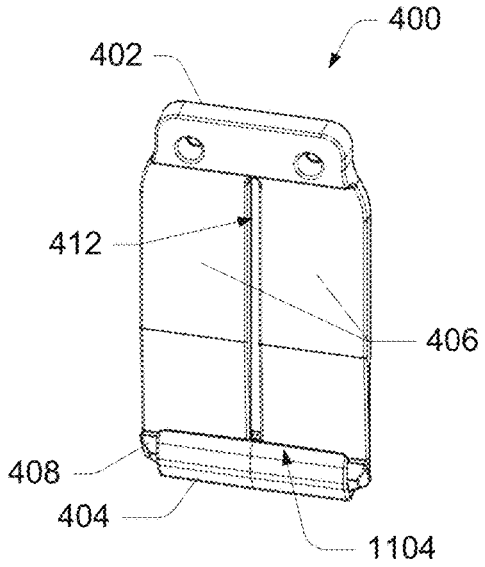
Figure 18:
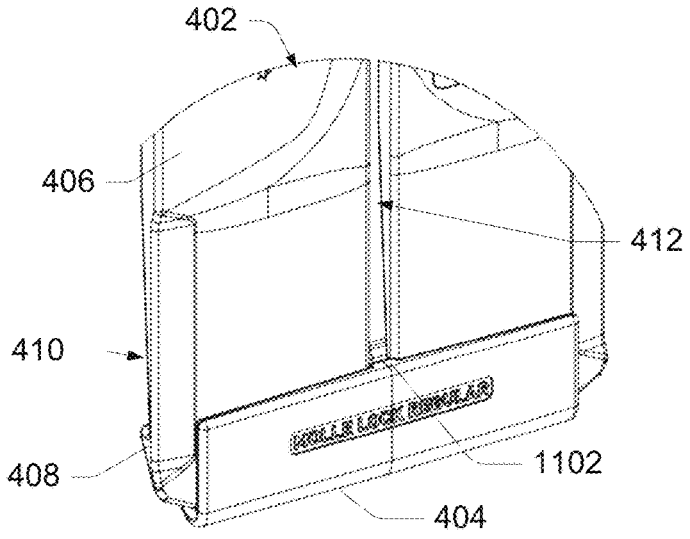
Figure 19:
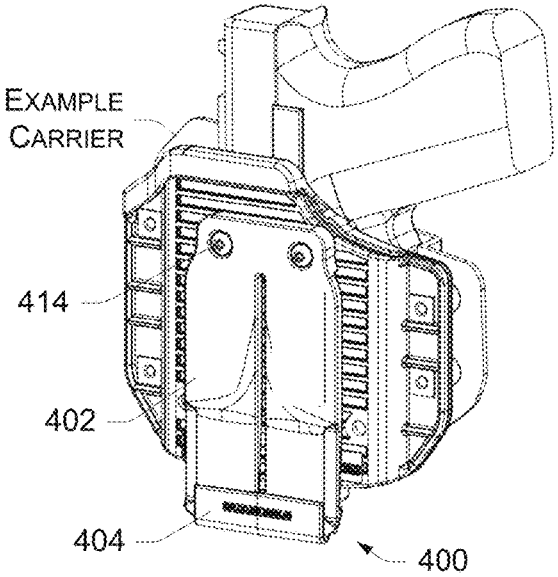
FIGS. 19-24 show example applications of the mount assembly of FIG. 4, according to an implementation.
Figure 20:
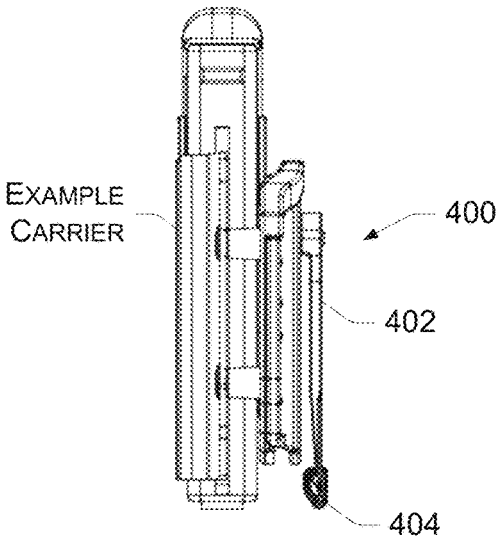
Figure 21:
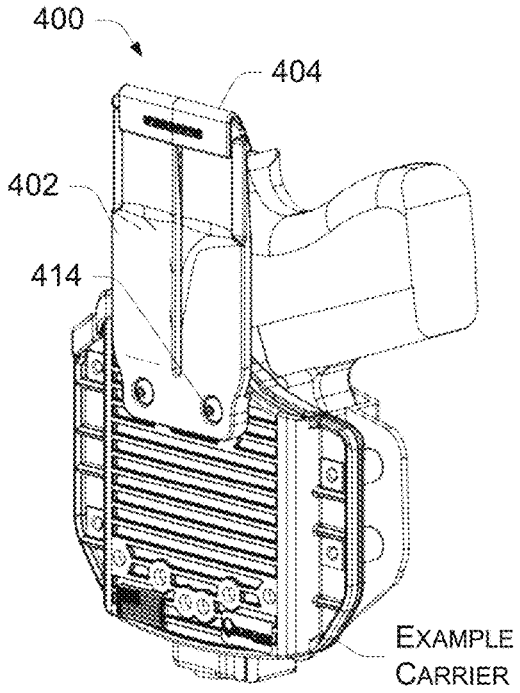
Figure 22:
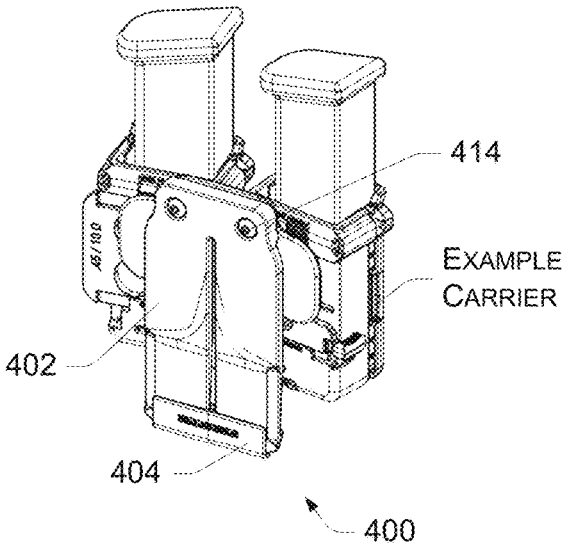

In an embodiment, as shown in FIGS. 1-3, a mount 100 includes a front plate 102 and a hinge plate 104. In various implementations, the mount 100 may include additional components. The front plate 102 and the hinge plate 104 are arranged to be fit together as shown, with a strap (for example) of a backpack, gear pack, etc. sandwiched between them, and held tightly by a friction fit. The front plate 102 and the hinge plate 104 are arranged to clamp together, connected at coupling points with one or more coupling bands or straps (not shown) such as hook and loop straps, etc., or other attachment means, clamps, etc., using the openings 106 (or other coupling means) in the front plate 102 and the hinge plate 104.

As shown in FIGS. 1-3, one or both of the front plate 102 and the hinge plate 104 can include features 108 on a surface of the front plate 102 and/or the hinge plate 104 to add friction to the plates. In some cases the features 108 on the front plate 102 mate with features 108 on the hinge plate 104 to give a secure fit between the two plates. The features 108 can include grids, ridges, protrusions, cavities, raised and/or relief patterns, zig-zags, spikes, wedges, or any other feature forms to add friction to the surfaces of the front plate 102 and the hinge plate 104. The combination of the features 108 and the coupling bands or straps (used at the openings 106) can create enough clamping force to keep the mount 100 from moving while supporting a heavy load, such as an implement.

The mount 100 can be moved on the strap it is mounted to if needed. Releasing the tension (e.g., loosening the attachment straps, for instance) between the front plate 102 and the hinge plate 104 allows the mount 100 to be slid to a new location on the strap. The front plate 102 is tightened to the hinge plate 104 to press the front plate 102 and the hinge plate 104 together, securing the mount 100 at the desired location.

The front plate 102 includes mounting holes 110 to mount the front plate 102 to the implement, a carrier such as a holster or shell, or to an adapter (for instance, a quick release adapter) that can be coupled to the implement, the carrier, or the like. In various implementations, the mount 100 may include additional or alternate components, or have different shapes or sizes than those illustrated.

In another embodiment, as shown in FIGS. 4-24, a mount 400 includes a panel mount portion 402 and a keeper portion 404. The panel mount 402 is adapted to slide behind straps on a backpack, gear pack, belt, clothing, etc. The removable keeper 404 is adapted to slide onto the panel mount 402 to secure it in place on the straps. The keeper 404 is removed to remove the panel mount 404 from the straps. In some embodiments, the keeper 404 is optional. In other embodiments, different sized or shaped keepers 404 may be used to adapt the panel mount 402 to different strap sizes and configurations.

Figure 23:
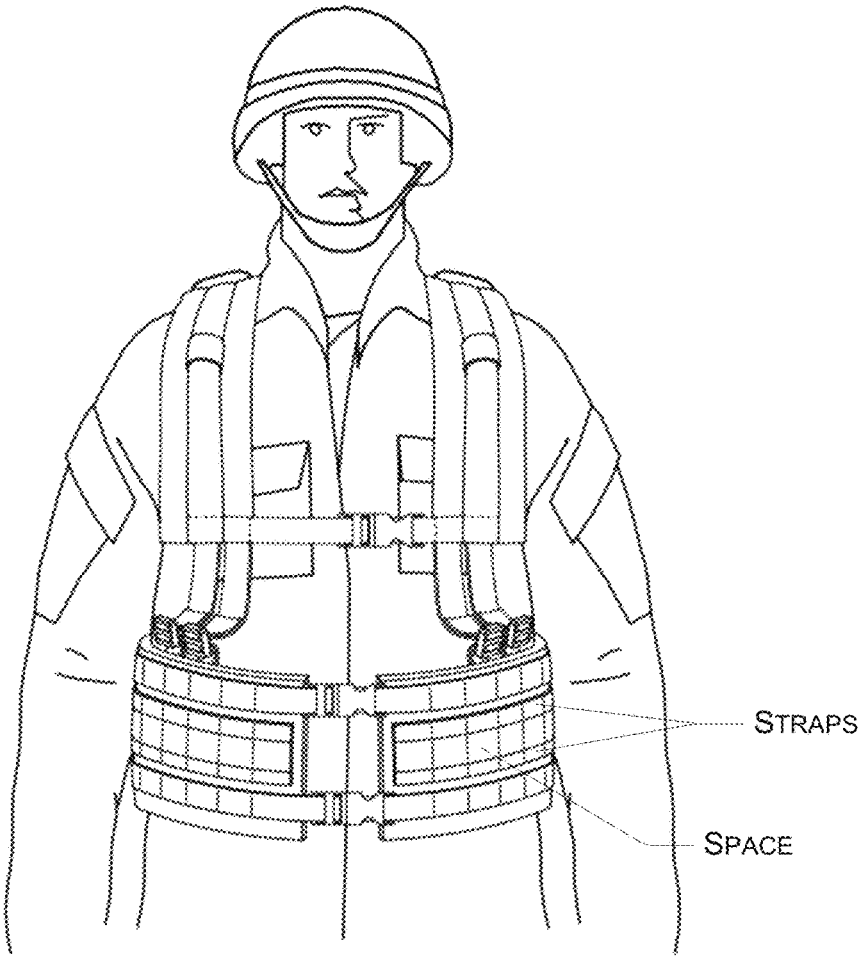
Figure 24:
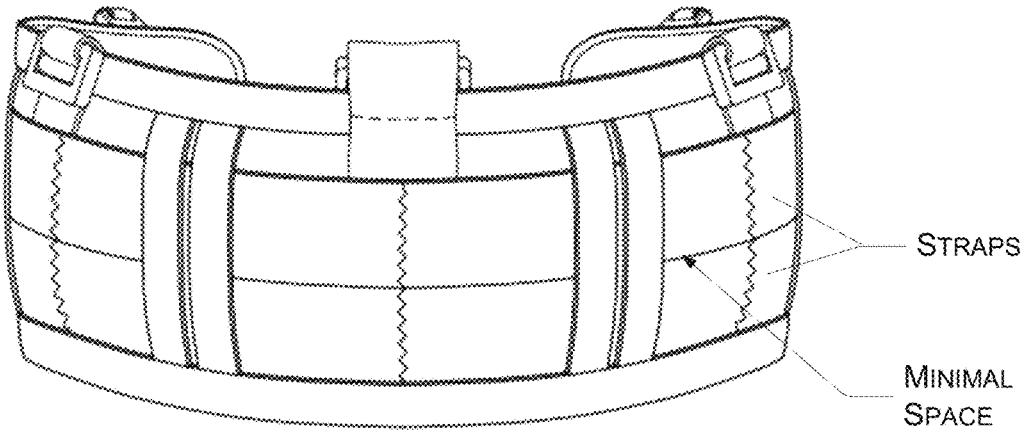
Figure 25:
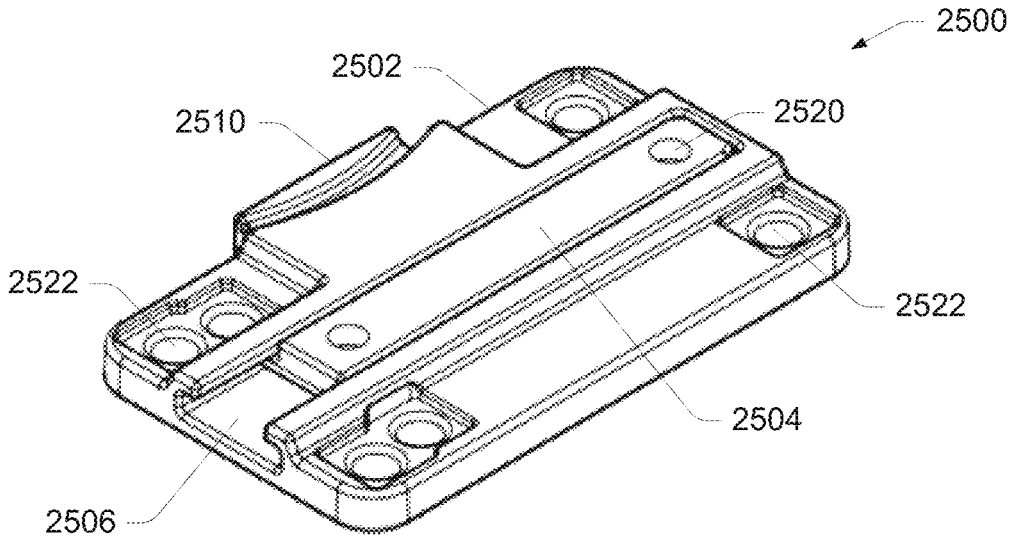
FIGS. 25 and 26 show perspective views of an example mount assembly, according to a further embodiment.

The panel mount 402 provides a rigid surface to attach an object (such as an implement or holster) to, and is removably attachable to a textile or other flexible surface such as an article having "Pouch Attachment Ladder System (PALS)" webbing (see FIGS. 23 and 24). The panel mount 402 can interface with the modular PALS system (or other straps) and provides a hard-mount attachment point to secure implements and other rigid objects. The rigidity of the panel mount 402 restricts the flexibility of the straps at the point of attachment to provide a secure mounting location for a heavy object, such as an implement.

As shown in FIGS. 4-18, the panel mount 402 is comprised of one or more substantially planar tabs 406 attached at one end of the tabs 406 and having a ridged, curved, or hooked portion 408 at the opposing end, with a shallow depression or recess 410 (an area of the tabs 406 that has a reduced thickness) that runs a partial length of each tab 406. A groove 412 runs between the tabs 406 when more than one tab 406 is present, or when a single tab 406 is divided. Accordingly, the groove 412 may include a complete separation or a shallow depression.

To couple the mount 400 to a flexible strap, the tabs 406 are slid underneath the flexible strap and can hook the strap as the ridge or hooked portion 408 protrudes out the opposite edge of the strap. The hooking action of the ridge 408 and the shallow recess 410 can resist unintentional removal of the tabs 406. Removing the tabs 406 intentionally includes unhooking the strap from the ridge 408 of the tabs 406.

Referring to FIGS. 15-18, the optional keeper 404 provides additional security against unintentional removal of the tabs 406 from the strap or webbing. The keeper 404 is slid over the ridge 408 and can be kept in place via a snap feature 1102 ("snap bump") that can snap into the groove 412 between the tabs 406, when present. In multiple tab 406 configurations, the keeper 404 slides on the tabs 406 to close around the webbing straps. To remove the mount 400, the keeper 404 is removed from the tab(s) 406 first, and the tabs 406 are removed from behind the strap, removing the panel mount 402 from the straps.

In various implementations, as shown in FIGS. 11-14, the keeper 404 has a roughly "U-shaped" cross-section to facilitate sliding over the tabs 406. In other examples, the cross-section has other shapes, and may include a lip 1104 that bends inward toward the tabs 406 to help secure the keeper 404 to the tabs 406. For example, the lip 1104 can engage at least a portion of the ridge 408 to help secure the keeper 404 to the tabs 406.

As shown in FIGS. 4-10 and 19-22, the panel mount 402 includes mounting holes 414 to couple the panel mount 402 to an implement, a carrier such as a holster or shell, or other object. Referring to FIGS. 19-22, the mounting holes 414 can be used to couple the panel mount 402 to the implement, carrier, or object in one or more configurations for a desired carry position.

Example application environments with modular webbing straps are shown at FIGS. 23 and 24. In various embodiments, the panel mount 402 and the keeper 404 can be sized to fit the size (width and spacing) of the straps. For example, a panel mount 402 and keeper 404 may be sized to capture 3 inches of standardized webbing (combination of strap width and spacing) in one configuration, such as shown in FIG. 23. In another configuration such as shown at FIG. 24, a configuration with 2 inches of webbing for instance (combination of strap width and spacing), a longer keeper 404 can be used to make the tab(s) 406 secure onto the webbing, by taking up space on the panel mount 402. In other embodiments, other configurations and sizes of panel mounts 402 and keepers 404 are contemplated. In various implementations, the mount 400 may include additional or alternate components, or have different shapes or sizes than those illustrated.

In a further embodiment, as shown in FIGS. 25-36, a mount 2500 includes a receiver portion 2502 and a slide component 2504. The receiver 2502 is adapted to be coupled to a belt, a strap, a holster paddle, a wall, a desk, a car interior, etc. The slide 2504 is coupled to an implement, a carrier such as a holster or holster shell, or the like. The slide 2504 is adapted to slide into a groove 2506 in the receiver 2502 to securely couple the implement or carrier to the belt, strap, holster paddle, wall, desk, car interior, and so forth.

Figure 26:
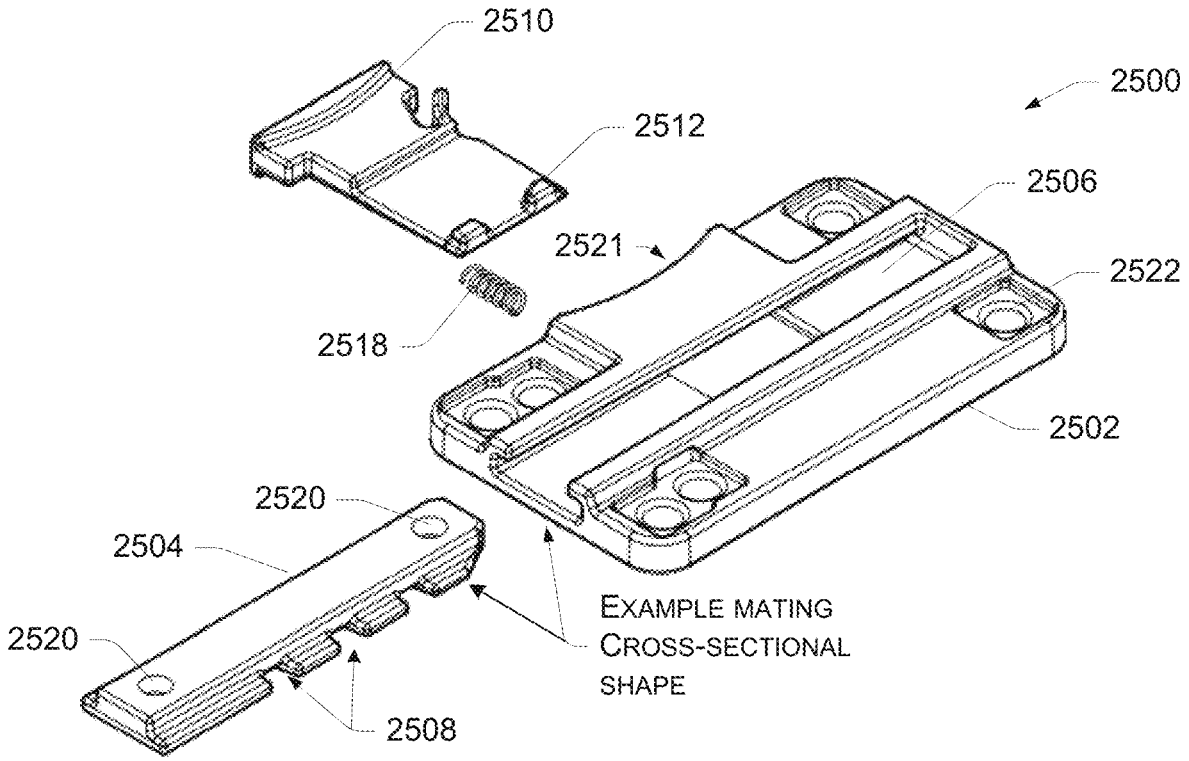
Figure 27:
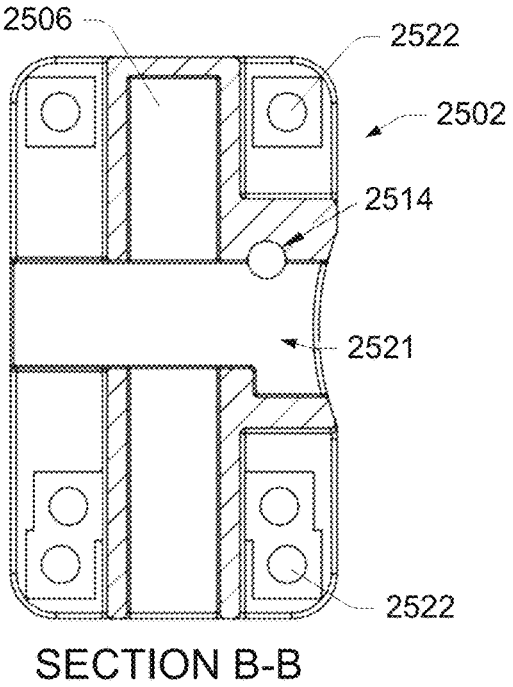
FIGS. 27-33 show example components of the slide mount of FIG. 25, according to an implementation.
Figure 29:
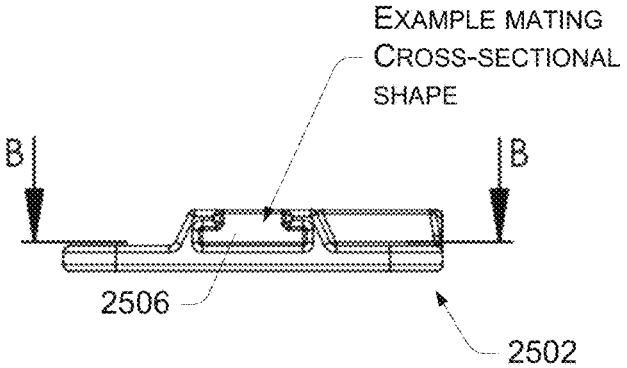
Figure 30:
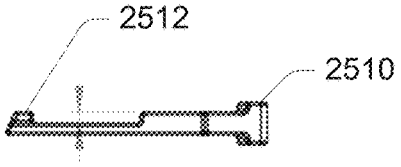
Figure 33:
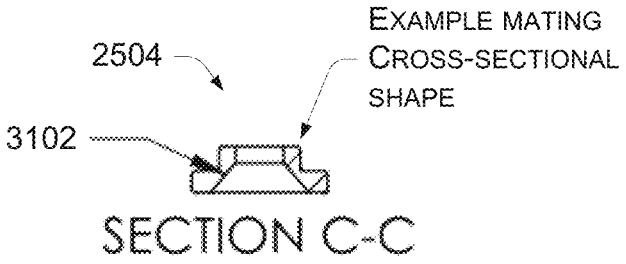

The slide 2504 and groove 2506 are adapted to mate in a secure manner, and in various embodiments (as illustrated in FIGS. 26, 29 and 33), may be designed with one or more of various cross-sectional shapes to accomplish that goal (dovetail, bevel, polygonal, elliptical, t-shaped, etc.). The slide 2504 locks in place, at a desired position within the groove 2506, using a series of notches 2508 in the slide 2504 and a spring-loaded button 2510 in the receiver 2502. The button 2510 includes a nub 2512 that is shaped to fit into the notches 2508 of the slide 2504 when the button 2510 is at rest.

For example, the slide 2504 (coupled to the implement, for instance) is moved into the groove 2506 to couple the slide 2504 to the receiver 2502. The slide 2504 can have a ramped surface 3102 on the lead end of the slide 2504 to facilitate entry into the groove 2506. As the slide 2504 moves through the groove 2506, the nub 2512 on the spring-loaded button 2510 snaps into a notch 2508 in the slide 2504, self-locking the slide 2504 in place. The user can operate the button 2510 to release the slide 2504 (moving the nub 2512 out of the notch 2508), to move the slide 2504 to a new position within the groove 2506 or to remove the slide 2504 from the receiver 2502. The possible positions of the slide 2504 within the groove 2506 is determined by the number and spacing of the notches 2508 in the slide 2504.

Figure 28:
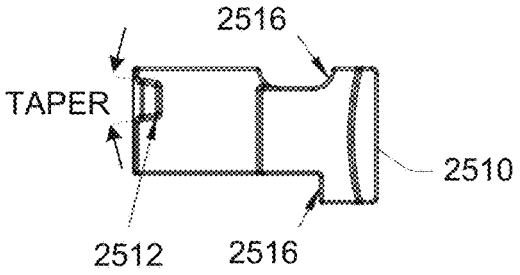
Figure 31:
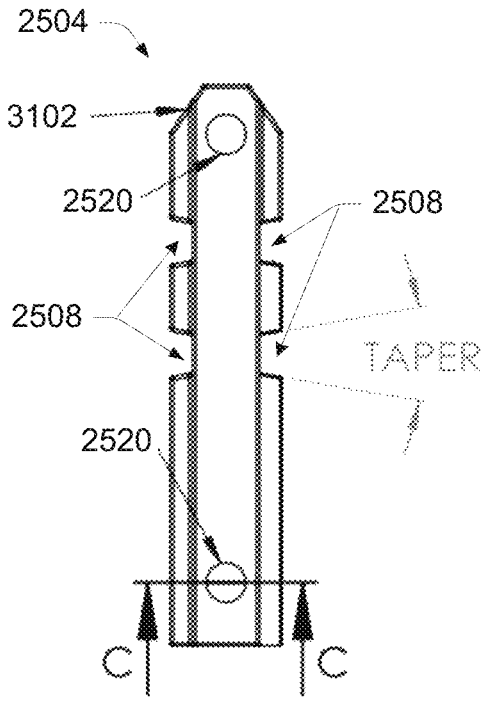
Figure 32:
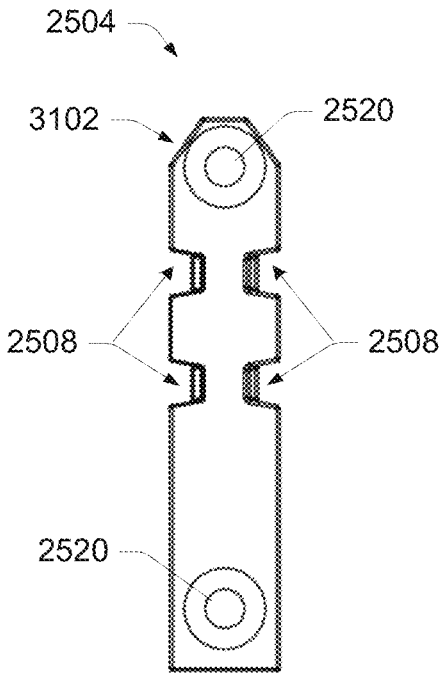

As detailed in FIGS. 28, 31, and 32, the notches 2508 and the nub 2512 on the button 2510 are formed with a matching taper for a more secure fit and hold. The receiver 2502 has a fetcher point 2514 (such as a hole for a bolt or pin) that can interact with a fetcher slot 2516 on the button 2510 to limit the travel of the button 2510 and prevent the button 2510 from coming out of the receiver 2502. The button 2510 may be spring-loaded using any type of spring device 2518, or the like, to maintain a secure fit between the nub 2512 and a notch 2508 in the slide 2504, preventing the slide 2504 from moving within the groove 2506 unintentionally. In some cases, multiple buttons 2510 may be used with notches 2508 on one or both edges of the slide 2504, or a single button 2510 may be used to operate nubs 2512 (or the like) corresponding to notches 2508 on both sides of the slide 2504. The button 2510 may be disposed (and adapted to move) within a cavity 2521, a depression, a groove, or the like, for instance, in the receiver 2502.

Figure 34:
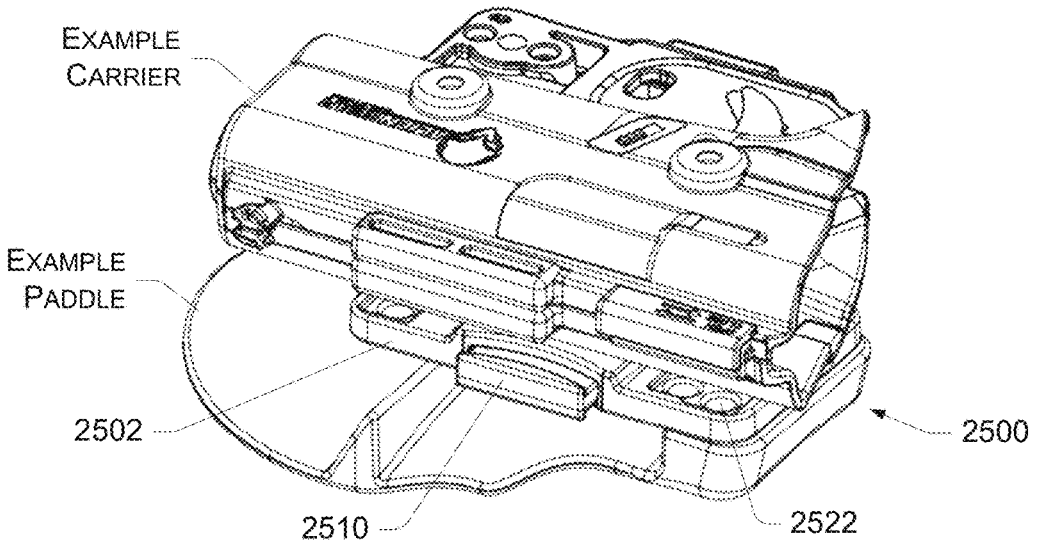
FIGS. 34-36 show views of an example application for the slide mount of FIG. 25, according to an implementation.
Figure 35:
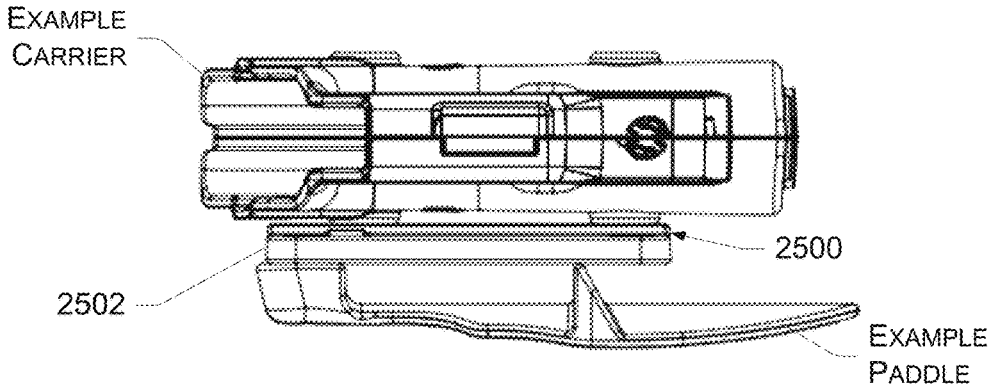
Figure 36:
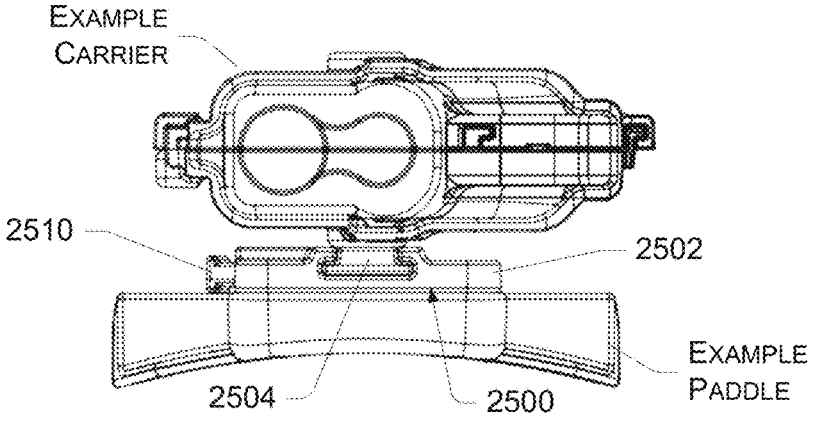

FIGS. 34-36 illustrate one example application of the mount 2500. In the illustration, a handgun holster (e.g., carrier) is coupled to a paddle for outside-the-waistband (OWB) carry, using the mount 2500. The slide 2504 is coupled to the holster using mounting holes 2520 on the slide 2504. The receiver 2502 is coupled to the paddle using mounting holes 2522 on the receiver 2502. The example mount 2500 arrangement allows for a quick change of different holster shells on the paddle, with easy height adjustment (using the multiple notches 2508 on the slide 2504 and the button 2510 on the receiver 2502). The mount 2500 also allows the user to have multiple receivers 2502 in various locations (attached to another belt coupler, attached to a wall, a desk or bed, the interior of a car, and so forth) for quick mounting options of the implement or holster.

In various implementations, the mount 2500 may include additional or alternate components, or have different shapes or sizes than those illustrated.

The mount 100, 400, and 2500 is discussed in terms of mounting and supporting a holster, but the mount 100, 400, and 2500 may also be used to mount and support various other cases, enclosures, and the like, where mounting options of the item are desired. Although various implementations and examples are discussed herein, further implementations and examples may be possible by combining the features and elements of individual implementations and examples.

In various implementations, components of the mount 100, 400, and 2500 are comprised of various plastics, composites, metals, combinations of the same, or the like. For example, the mount 100, 400, and 2500 components may be comprised of a polyamide, or similar material. For example, the mount 100, 400, and 2500 components may be injection molded, stamped, formed, or the like. In various embodiments, the mount 100, 400, and 2500 components have rigidity and stability properties based on a particular material selected for the mount 100, 400, and 2500 components. For example, some materials that may be used include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, various metals and alloys, fiber composites, combinations of the same, and the like. Additionally, in some embodiments, the stability properties are also based on a thickness of the mount 100, 400, and 2500 components.

In various implementations, the mount 100, 400, and 2500 may include fewer, more, or alternate components, and remain within the scope of the disclosure. In various embodiments, the shape and configuration of the mount 100, 400, and 2500 components may vary to accommodate different implements or applications. In an example, the mount 100, 400, and 2500 components may be formed to closely fit a particular implement or carrier. In other examples, the mount 100, 400, and 2500 components may be more generally formed to fit multiple implements or carriers.

The illustrations of FIGS. 1-36 are not intended to be limiting. In the various example embodiments illustrated in FIGS. 1-36, the location and position of the components, mechanisms, and the like are for example only. Other locations and positions are contemplated and are within the scope of this disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a mount 100, 400, and 2500 may be implemented as a stand-alone device or as part of another system (e.g., integrated with other components, or the like). In various implementations, additional or alternative components may be used to accomplish the disclosed techniques and arrangements.

In various embodiments, the mount 100, 400, and 2500 may be added to an existing arrangement (such as holsters and holster mounting apparatus and assemblies, for example). For instance, the existing arrangements may be retrofitted with the mount 100, 400, and 2500 or with mount 100, 400, and 2500 components. In other embodiments, the mount 100, 400, and 2500 may be a part of a new arrangement, such as a new holster rig, case, enclosure, or the like.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. A mounting assembly, comprising:

a receiver, comprising a substantially planar hard mount component, including:

a groove recessed into a surface of the hard mount component, the groove extends a length of the hard mount component and has a predetermined cross-sectional shape, the groove includes an opening at a first edge of the hard mount component; and a cavity disposed within the hard mount component, below the surface of the hard mount component, the cavity extends a width of the hard mount component and intersects the groove, the cavity includes an opening at a second edge of the hard mount component;

a narrow slide with a cross-sectional shape that is complementary to the predetermined cross-sectional shape of the groove, the complementary cross-sectional shape of the slide is configured to mate with the predetermined cross-sectional shape of the groove to slideably couple the slide to the receiver via the groove, the slide includes one or more notches in an edge of the slide; and a lock mechanism adapted to engage one or more of the notches of the slide to hold a position of the slide relative to the receiver when the slide is within the groove, the lock mechanism comprising a spring-loaded button moveably coupled to the receiver, the button having at least one nub adapted to engage a notch in an edge of the slide that faces an edge of the hard mount component opposite to the second edge when the slide is within the groove and the button is at rest.

2. The mounting assembly of claim 1, wherein the lock mechanism determines a position of the slide within the groove when the button is at rest.

3. The mounting assembly of claim 1, wherein the button is disposed within the cavity and protrudes from the opening at the second edge of the hard mount component.

4. The mounting assembly of claim 1, wherein the slide overlaps the button when the slide is within the groove.

5. The mounting assembly of claim 1, wherein a position of the slide with respect to the receiver is adjustable by engaging one or more other of the notches of the slide.

6. The mounting assembly of claim 1, wherein the at least one nub has a shape adapted to securely fit within the one or more notches in the edge of the slide.

7. A mounting assembly, comprising:

a receiver, comprising a substantially planar hard mount component, including:

a groove recessed into a surface of the hard mount component, wherein the groove extends a length of the hard mount component and has a predetermined cross-sectional shape, the groove includes an opening at a first edge of the hard mount component; and a cavity disposed within the hard mount component, below the surface of the hard mount component, wherein the cavity extends a width of the hard mount component and intersects the groove, the cavity includes an opening at a second edge of the hard mount component;

a narrow slide with a cross-sectional shape that is complementary to the predetermined cross-sectional shape of the groove, the complementary cross-sectional shape of the slide is configured to mate with the predetermined cross-sectional shape of the groove to slideably couple the slide to the receiver via the groove, the slide includes a plurality of notches in an edge of the slide; and a lock mechanism comprising a spring-loaded button including a plurality of nubs at an end of the button opposite the opening at the second edge of the hard mount component that engage a subset of the plurality of notches of the slide to hold a position of the slide relative to the receiver when the slide is within the groove and the button is at rest.

8. The mounting assembly of claim 7, wherein the slide includes a ramped surface at a lead end of the slide.

9. The mounting assembly of claim 7, wherein the predetermined cross-sectional shape comprises one of dovetail, bevel, polygonal, elliptical, or t-shape.

10. The mounting assembly of claim 7, wherein the spring-loaded button is adapted to self-lock the slide within the groove when the slide is inserted into the groove and the button is at rest.

11. The mounting assembly of claim 10, wherein the plurality of nubs are fixed to or integral to the button, at an end of the button.

12. The mounting assembly of claim 10, wherein the nubs disengage the notches of the slide when the button is depressed, the nubs moving away from the opening at the second edge of the hard mount component and allowing the slide to move freely when the button is depressed.

13. The mounting assembly of claim 7, wherein each of the notches of the plurality of notches includes a tapered shape and each of the nubs of the plurality of nubs includes a tapered shape, and wherein a taper of each of the plurality of notches matches a taper of each of the plurality of nubs.

14. The mounting assembly of claim 7, wherein the slide is adjustable relative to the receiver in a discrete quantity of positions based on a quantity of notches of the plurality of notches.

15. The mounting assembly of claim 7, wherein the receiver is coupled to a paddle and wherein the slide is coupled to a carrier, and wherein the paddle is coupled to the carrier when the slide is slideably coupled to the receiver.

16. The mounting assembly of claim 15, wherein the carrier comprises a handgun holster.

17. The mounting assembly of claim 15, wherein a position of the carrier relative to the paddle is adjustable based on a selection of the subset of the plurality of notches engaged by the plurality of nubs.

18. A holster mounting assembly, comprising:

a receiver, comprising a substantially planar hard mount component, including:

a groove recessed into a surface of the hard mount component, the groove extends a length of the hard mount component and has a predetermined cross-sectional shape, the groove includes an opening at a first edge of the hard mount component; and a cavity disposed within the hard mount component, below the surface of the hard mount component, the cavity extends a width of the hard mount component and intersects the groove, the cavity includes an opening at a second edge of the hard mount component;

a narrow slide with a cross-sectional shape that is complementary to the predetermined cross-sectional shape of the groove, the complementary cross-sectional shape of the slide is configured to mate with the predetermined cross-sectional shape of the groove to slideably couple the slide to the receiver via the groove, the slide includes one or more notches in an edge of the slide; and a spring-loaded button disposed within the cavity and moveably coupled to the receiver and protruding from the opening at the second edge of the hard mount component, the button having at least one nub at an end of the button opposite the opening at the second edge of the hard mount component adapted to engage the one or more notches of the slide when the button is at rest to determine a position of the slide within the groove and to hold the position of the slide relative to the receiver when the slide is within the groove.

19. The holster mounting assembly of claim 18, wherein the receiver includes at least one mounting hole adapted to couple the receiver to a desired surface and the slide includes at least one mounting hole adapted to couple the slide to a carrier, the holster mounting assembly adapted to couple a holster to the desired surface when the slide is coupled to a holster and the slide is slideably coupled to the receiver.

* * * * *